United States Patent [19]

Romerdahl et al.

[11] 4,201,967

[45] May 6, 1980

[54] THERMAL SWITCH AND METHOD OF ASSEMBLY AND TOOL USED THEREIN

[75] Inventors: Ronald W. Romerdahl, Redmond; Milton R. Knight, Rothwell, both of Wash.

[73] Assignee: Sundstrand Data Control, Inc., Redmond, Wash.

[21] Appl. No.: 906,099

[22] Filed: May 15, 1978

[51] Int. Cl.[2] ..... H01H 37/52; H01H 61/00

[52] U.S. Cl. ..... 337/354; 337/89; 337/94; 337/347

[58] Field of Search ..... 337/53, 89, 343, 348, 337/354, 365, 379, 62, 148, 94, 347, 368

[56] References Cited

U.S. PATENT DOCUMENTS

| | | | |
|---|---|---|---|
| 2,390,947 | 12/1945 | Koci | 337/393 |
| 2,487,683 | 11/1949 | Wilson | 337/379 |
| 2,777,034 | 1/1957 | King et al. | 337/298 |
| 2,966,062 | 12/1960 | Eskin et al. | 73/378.3 |
| 3,002,386 | 10/1961 | Flanagan | 337/365 |
| 3,091,121 | 5/1963 | Moorhead | 337/317 |
| 3,096,418 | 7/1963 | Odenwald | 337/379 |
| 3,194,074 | 7/1965 | Anderson et al. | 337/394 |
| 3,369,093 | 2/1968 | Harper | 337/89 |
| 3,369,093 | 2/1968 | Harper, Jr. | 337/89 |
| 3,452,706 | 7/1969 | Vogt | 73/378.3 |
| 3,845,440 | 10/1974 | Hunter | 337/341 |
| 4,047,141 | 9/1977 | Holden | 337/89 |

*Primary Examiner*—George Harris
*Attorney, Agent, or Firm*—Wegner, Stellman, McCord, Wiles & Wood

[57] ABSTRACT

A thermal switch having contacts with one contact being movably mounted on a carrier and with movement of the carrier controlled by a bimetal actuator disc. The actuating movement is transmitted through a striker pin of molded ceramic material which is fastened in fixed relation to the carrier by a layer of adhesive of controllable thickness to establish the effective length of the striker pin.

The method of manufacturing the thermal switch embodies holding of the striker pin in fixed predetermined relation to components of the thermal switch. During movement of the parts to this position, a mass of adhesive carried at an end of the striker pin is pressed between the end of the striker pin and the carrier to provide lateral flow thereof until said pressing is discontinued to provide a controlled thickness layer of adhesive which is then set with the parts held in a predetermined relation. A tool used in the method comprises a disc having a central opening with a bottom wall to receive a lower part of the striker pin and hold the upper end of the striker pin oriented for movement relative to the carrier as the components are brought into said predetermined relation.

16 Claims, 4 Drawing Figures

THERMAL SWITCH AND METHOD OF ASSEMBLY AND TOOL USED THEREIN

BACKGROUND OF THE INVENTION

This invention pertains to thermal switches and the method of manufacture thereof as well as a tool usable in said method.

In most snap-acting bimetal disc type thermal switches, the snap action of the disc is coupled to the contact mechanism by an insulated coupling pin or plunger, commonly referred to as the striker pin. This pin is normally made from vitreous-type material. The length of this pin must be precisely controlled to properly couple the snap travel of the disc to the contacts. Incorrect pin lengths result in improper switch action and either gross reduction in switching life or susceptability to intermittent contact closings during vibration. Normal manufacturing tolerances do not allow this pin length to be controlled directly without extraordinarily tight controls on the several parts that make up the assembly. As a result, normal practice has been to manufacture the detail parts to common tolerances, and compensate for the total accumulation of plus and minus tolerances by use of a striker pin fitted to each specific application. Two common methods are now used to fit the pin length to each switch. Both have limitations and advantages. The new method proposed herein combines the advantages of both and eliminates their fundamental disadvantages.

The most commonly used current procedure utilizes a free floating coupling pin, manufactured in incremental lengths to cover all possible combinations of tolerance accumulations. Each switch-contact assembly is measured using specialized gauges, which relate the geometry of each assembly to a specific pin size. The specified pin length is selected from available stock and installed in the switch. Since the design approach does not attach the pin to any support, it is free to rattle and bounce within the enclosure, where contamination from rubbing surfaces can be generated. Vibration and shock exposures can also impact the floating pin on the contact assembly, causing inadvertent openings or closings of switch contacts. Fractures of the pin as a result of extreme shock and vibration levels have also been observed.

The other commonly used procedure for obtaining correct pin length has been to mechanically attach a pin of sufficient length to compensate for all combinations of detail parts to a fixed part of the assembly, and then trim it to the specific dimension required. This design provides superior resistance to high vibration and shock levels, since no "loose" parts are used in the disc-to-armature geometry. However, the trimming operation does, by its nature, create debris in the form of chips or grindings which have the potential for contaminating switch contacts. Elaborate procedures are sometimes required to be absolutely sure that switches are thoroughly cleaned.

In grinding of a pin to length, a flat lower end is formed which results in harmful abrasive wear of the actuator disc by repeated contact therewith. Additionally, the grinding leaves a sharp lower edge with the result that particles may break off during use to cause contamination.

SUMMARY OF THE INVENTION

A primary feature of the invention is to provide a thermal switch utilizing the advantages of prior designs while avoiding the disadvantages thereof. This is accomplished by utilization of a fixed, pre-formed striker pin of fixed length to provide high vibration and shock resistance and which avoids sizing or trimming either before or after assembly. It utilization of a striker pin which need not be sized or trimmed, the pin is free of the effects of grinding or other trimming which can leave frangible cracks, slits or nonuniform sharp edges and, specifically, the striker pin has an end of a spherical shape which can be formed as a molded part thereof.

In accordance with the foregoing, an object of the invention is to provide a thermal switch having a movable contact on a carrier such as an armature spring positionable under the control of a bimetal actuator with a striker pin engageable by the actuator for transmitting motion of the actuator to the carrier and with the striker pin being fixed to the carrier by a controlled thickness layer of adhesive to establish an effective length for the striker pin.

Another object of the invention is to provide a thermal switch as defined in the preceding paragraph wherein the components of the switch are carried by a cylindrical case with a base and a header positionable in the case and spaced from the base and with the case carrying the bimetal actuator in final assembly of the switch, but prior thereto mounting an installation tool in place of the actuator for holding the striker pin in a fixed position as the header and case are moved into predetermined relation during preliminary assembly.

Another object of the invention is to provide an installation tool usable in manufacturing a thermal switch wherein the tool is in the form of a disc positionable within the cylindrical case of the thermal switch at the same location as the actuator disc and has a central opening with a bottom wall to hold a striker pin in fixed position and extending therefrom whereby the striker pin is brought into associated relation with an armature spring of the switch as a header carrying the armature spring is moved into relation with the case.

Still another object of the invention is to provide a method for manufacturing the thermal switch having the structure set forth in the preceding paragraphs and using the tool described above wherein a mass of adhesive is placed on the upper end of the striker pin while it is held by the tool and said adhesive is caused to flow laterally as the striker pin is brought into final relation with the armature spring to leave a controlled thickness layer of adhesive which is then set to fix the striker pin to the armature spring. Thereafter, the header and case are separated for removal of the installation tool and insertion of the bimetal actuator with reassembly of the header and the case for final assembly of the thermal switch.

From the foregoing, it will be seen that a thermal switch is provided without creation of any contamination within the switch and with a structure and assembly using the controlled adhesive layer thickness whereby all of the striker pins can be of one standard length and each striker pin is automatically set to a predetermined length by the controlled thickness layer of adhesive.

DESCRIPTION OF THE PREFERRED EMBODIMENT

Figure 1:
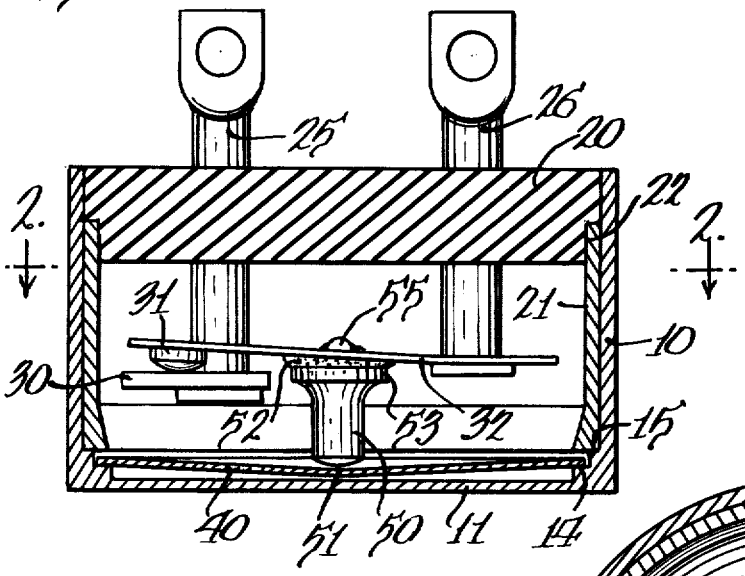
FIG. 1 is a vertical central section of the thermal switch.
Figure 2:
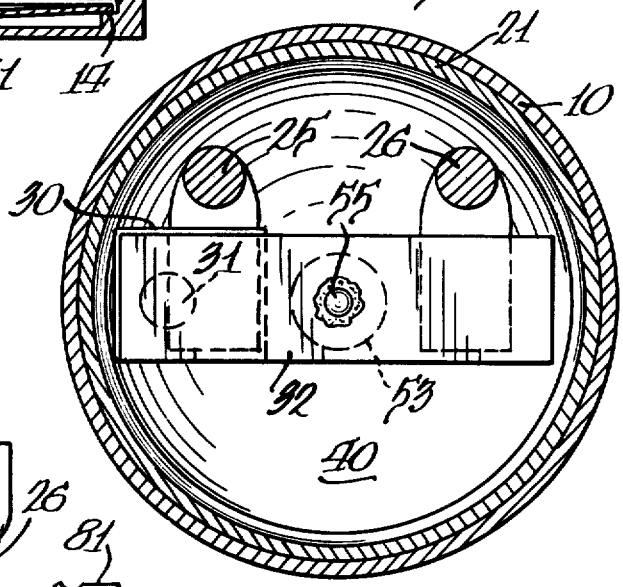
FIG. 2 is a plan section, taken generally along the line 2—2 in FIG. 1.

The thermal switch has a cylindrical case 10 with a base 11 with a pair of annular steps or lands 14 and 15 around the interior thereof and spaced above the base. A header 20 is positioned within the case and spaced from the base by a ring 21 having its lower edge supported on the case land 15 and having its upper end interfitting with a peripheral groove 22 on the header 20. The header, by insulating structure, mounts a pair of spaced-apart conductive terminal posts 25 and 26 which have their lower ends extending beneath the header and into the space between the header and the case base 11. The terminal posts provide an electrically conductive path to a fixed contact 30 carried at the lower end of the terminal post 25 and a movable contact 31 mounted on a carrier 32 in the form of a planar armature spring which is mounted at an end thereof in a cantilever fashion to the lower end of the terminal post 26.

As shown in FIG. 1, the contacts 30 and 31 are in engagement. Upward pivoting of the armature spring 32 moves the movable contact 31 out of engagement with the fixed contact 30.

The control of the movable contact 31 is by an actuator 40 in the form of a thermally-responsive bimetal disc having its peripheral edge resting on the case land 14. As shown in FIG. 1, the disc is upwardly concave, as permitted by a space between the disc and the case base 11. In response to a temperature change of a predetermined degree, the disc will shift to an upwardly convex relation and through the intermediary of a striker pin 50 fixed to the armature spring 32, the latter will be pivoted upwardly to separate the contacts 30 and 31.

The striker pin 50 is formed of a molded ceramic material and has a spherical lower end 51. The lower end 51 is normally spaced a critical distance from the actuator disc 40 so that slight movement of the disc will not effect contact engagement. The striker pin is fixed to the armature spring by means of an adhesive layer 52 of controlled thickness and which is shown in FIG. 1 between an upper end 53 of the striker pin and the armature spring 32. In addition to the bonding provided by the adhesive, a projection 55 extending from the upper end 53 of the striker pin fits within an opening (not shown) in the armature spring 32. Many adhesives are suitable, including a thermosetting epoxy adhesive.

Figure 3:
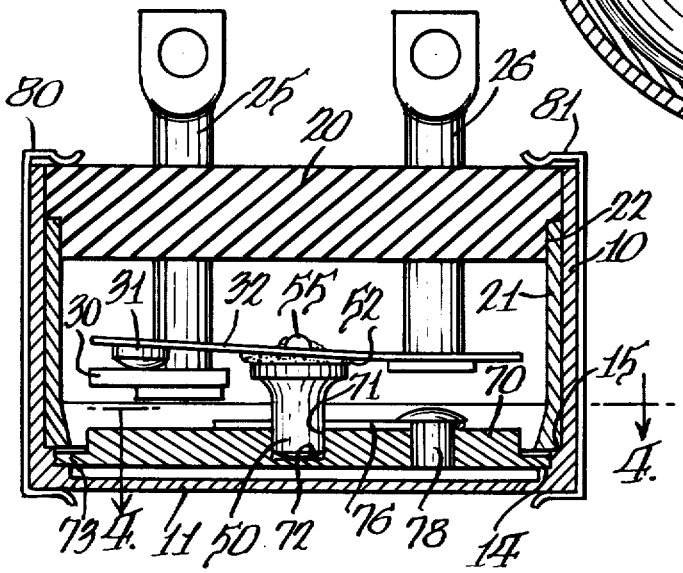
FIG. 3 is a view, similar to FIG. 1, showing a step in assembly of the thermal switch and utilizing the installation tool.
Figure 4:
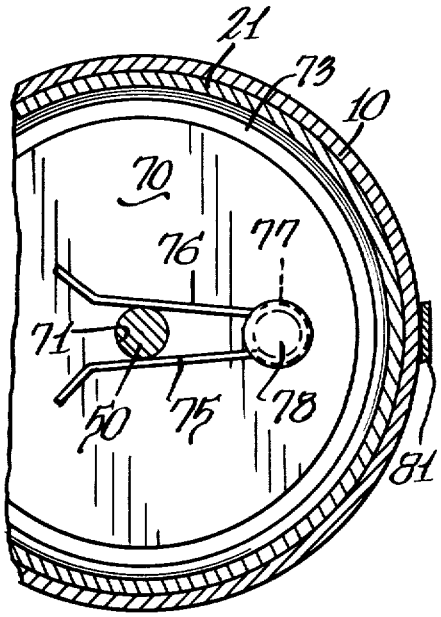
FIG. 4 is a fragmentary plan section, taken generally along the line 4—4 in FIG. 3.

The thermal switch has components assembled by a method or process which embodies the use of an installation tool, shown in FIGS. 3 and 4. The installation tool is in the form of a disc 70 having a central opening 71 with a bottom wall 72. Additionally, the thickness of the tool disc is reduced at the periphery thereof, as indicated at 73. As seen in FIG. 3, the tool disc 70 is positioned within the case 10 and rests on the land 14 in place of the actuator disc 40. The central opening 71 receives a lower part of the striker pin 50 and with the lower spherical end 51 thereof engaging the bottom wall 72. This provides a controlled location for the striker pin relative to the case 10. The striker pin is held on the tool in upright relation by means of a spring clip having legs 75 and 76 extending across the opening 71 and having an intermediate part 77 engaged by a screw 78 to hold the spring on the disc.

With the striker pin 50 held on the tool 70, as shown in FIG. 3, a mass of adhesive is placed at the upper end 53 of the striker pin. The header 20 and spacer ring 22 are then moved downwardly within the case to bring the spacer ring into its normal position engaging against the case land 15. This orients all the components in the final relation and, during this movement, the projection 55 on the striker pin has moved into the opening of the armature spring and pressure has been exerted on the mass of adhesive 52. Sufficient adhesive has been placed on the striker pin to make certain that there will always be an excess of adhesive and with the excess flowing out laterally from the gap between the striker pin 50 and the armature spring 32. This results in a controlled thickness layer of adhesive with the pressing thereon terminating when the header, spacer ring, and case are in fully-assembled position. The adhesive may then be set while the parts are held together by clips 80 and 81. The thickness of the adhesive layer may not be uniform because of the slight angle of the armature spring 32. Thereafter, the clips are removed and the header and spacer ring and components carried thereby are removed from the case. The tool 70 can then be removed from the case and replaced by the actuator disc 40 and the header and spacer ring are then again reinserted for final assembly of the thermal switch.

The distance between case lands 14 and 15 can be accurately machined and, therefore, use of the tool 70 enables an accurate location of the lower end of the striker pin relative to actuator disc 40 which is ultimately placed at the same location as the tool. The tool 70 rests on land 14 and the spacer ring rests on land 15. Therefore, after final assembly, the spacer ring on land 15 and the actuator disc resting on land 14 are a known distance apart.

With the structure and method described herein, it will be seen that the machining, wear, and contamination problems of the prior art have been avoided and with there being a reduced skill level required for assuring proper effective length of a striker pin along with assurance of radial centering of the striker pin relative to the actuator disc. Additionally, the use of the controlled thickness layer of adhesive permits the inventorying of one standard length of standard striker pin for a particular thermal switch and also absorbs tolerance build-up between the various components of the thermal switch by bringing the parts into relation shown in FIG. 3 and utilizing the variable thickness adhesive layer as a final determinant of location and effective length of the striker pin.

We claim:

1. A thermal switch having a fixed contact, a movable contact, an armature spring carrying the movable contact, a thermally-responsive actuator spaced from and movable toward and away from the armature spring, a striker pin carried on the armature spring for transmitting actuating movement of the actuator to the armature spring, and a layer of adhesive between the striker pin and the armature spring for bonding thereof together and providing a controllable thickness layer to establish the effective length of the striker pin.

2. A thermal switch as defined in claim 1 wherein said armature spring is cantilever mounted by connection to a post adjacent an end thereof.

3. A thermal switch as defined in claim 1 wherein said armature spring has an opening therein and said striker pin has a projection at an end thereof engageable in said opening.

4. A thermal switch as defined in claim 1 wherein said actuator is a bimetal disc with the striker pin positioned centrally thereof and normally spaced therefrom when said contacts are in engagement.

5. A thermal switch having a cylindrical case with a base, a header positioned in said case and spaced from said base, a pair of spaced-apart terminal posts carried by said header and extending into the space between the base and header, an actuator disc of bimetal supported by said case for switch-controlling movement, a fixed contact on one of said terminal posts, an armature spring connected to the other terminal post and having a contact movable relative to the fixed contact, a striker pin of molded ceramic material extending at a generally right angle from said armature spring and having a spherical lower end adapted for engagement by the actuator disc, and a layer of adhesive fixing the striker pin to the armature spring and having a controlled thickness to establish the effective length of the striker pin.

6. A thermal switch as defined in claim 5 wherein said layer of adhesive is established by use of a tool in the form of a disc positionable in said case and having an opening with a bottom wall to receive a lower part of the striker pin with the spherical end engaging said bottom wall, and means on said tool disc for holding said striker pin upright.

7. A thermal switch having a contact on a movable carrier positionable under the control of a bimetal actuator, with a striker pin engageable by the actuator for transmitting motion of the latter to the movable carrier, the improvement comprising, a controlled thickness layer of adhesive bonding the striker pin to the movable carrier to establish the effective length of the striker pin.

8. A thermal switch as defined in claim 7 and manufactured by a process in which a mass of adhesive is placed between the carrier and the striker pin and the striker pin is pressed toward the carrier to cause some flow of adhesive from the space therebetween and held in a predetermined orientation to the carrier while the adhesive sets and said controlled thickness layer is established.

9. An installation tool for components of a thermal switch mounted on a header and positionable in a cylindrical case with said components including a striker pin extending generally normal from a carrier and fastened thereto by a layer of adhesive of a controllable thickness to establish an effective length for the striker pin, said tool comprising a disc positionable in said case and having a central opening with a bottom wall to receive a predetermined length of the striker pin remote from the carrier, and means on the tool disc to hold the striker pin upright.

10. A tool as defined in claim 9 wherein the thickness of the tool disc is reduced at the periphery thereof to have the tool disc edge positionable on a land in the case with said spacer ring having a lower end beneath the level of the top surface of the disc.

11. A tool for assembly of a striker pin to a carrier of a thermal switch comprising a circular disc having a central opening with a bottom wall to receive a predetermined length of a striker pin extending away from the disc, and spring means mounted on said disc and positioned to hold a striker pin positioned in said central opening.

12. A process for assembling components of a thermal switch mounted on a header and positionable in a cylindrical case with said components including a striker pin extending generally normal from a carrier and fastened thereto by a layer of adhesive of a controllable thickness to establish an effective length for the striker pin, said process comprising holding the striker pin in a predetermined orientation relative to said case, placing a mass of adhesive on an upper end of the striker pin, attaching the carrier to said header, moving said header into said case to a controlled depth to press the adhesive mass against the carrier and cause lateral flow thereof until said controlled depth is reached, holding said header and case together until the adhesive sets or cures, and thereafter removing the header from the case.

13. A process as defined in claim 12 wherein a removable tool is placed in said case to hold the striker pin in said predetermined orientation, and, after said adhesive is set, said tool is removed and a bimetal actuator disc positioned in the case in place of the tool followed by reassembly of the header into the case.

14. A thermal switch having a cylindrical case with a base and a locating land, a header positioned in said case, a spacer ring between the header and the base and positioned on said land for spacing the header from said base, a pair of spaced-apart terminal posts carried by said header and extending into the space between the base and header, a second land on said case, an actuator disc of bimetal supported on the second land of said case for switch-controlling movement, a fixed contact on one of said terminal posts, an armature spring connected to the other terminal post and having a contact movable relative to the fixed contact, a striker pin of molded ceramic material extending at a generally right angle from said armature spring and having a spherical lower end adapted for selective engagement by the actuator disc, and a layer of adhesive fixing the striker pin to the armature spring and having a controlled thickness to establish the effective length of the striker pin.

15. A thermal switch as defined in claim 5 wherein said layer of adhesive is established by use of a tool in the form of a disc positionable on said second case land in place of said actuator disc and having an opening with a bottom wall to receive a lower part of the striker pin with the spherical end engaging said bottom wall, and means on said tool disc for holding said striker pin upright, said tool being removed after the adhesive is set to permit placement of the actuator disc and final assembly of the switch.

16. A thermal switch as defined in claim 1 wherein said striker pin has a spherical lower end for selective engagement by said actuator.

* * * * *